US005800120A

United States Patent [19]

Ramsay

[11] Patent Number: 5,800,120

[45] Date of Patent: Sep. 1, 1998

[54] PUMP IMPELLER WITH ADJUSTABLE BLADES

[75] Inventor: Thomas W. Ramsay, Kitchener, Canada

[73] Assignee: A. W. Chesterton Co., Stoneham, Mass.

[21] Appl. No.: 742,634

[22] Filed: Nov. 1, 1996

[51] Int. Cl.[6] ..... F03D 11/00

[52] U.S. Cl. ..... 415/129; 415/131

[58] Field of Search ..... 415/203, 206, 415/129, 130, 131

[56] References Cited

U.S. PATENT DOCUMENTS

| | | | |
|---|---|---|---|
| 1,896,219 | 2/1933 | Buckley . | |
| 1,910,216 | 5/1933 | Gill | 415/129 |
| 3,228,656 | 1/1966 | Kyogoku . | |
| 3,407,740 | 10/1968 | Samerdyke . | |
| 3,482,523 | 12/1969 | Morando . | |
| 3,558,238 | 1/1971 | Herpt . | |
| 3,711,218 | 1/1973 | Kennel et al. . | |
| 3,877,844 | 4/1975 | Klaus et al. . | |
| 3,918,831 | 11/1975 | Grennan . | |
| 4,417,849 | 11/1983 | Morris . | |
| 4,614,445 | 9/1986 | Gerkema et al. . | |
| 4,754,155 | 6/1988 | Obermeyer . | |
| 5,624,226 | 4/1997 | Yamada et al. | 415/130 |

FOREIGN PATENT DOCUMENTS

| | | | |
|---|---|---|---|
| 1158780 | 5/1985 | U.S.S.R. | 415/206 |

*Primary Examiner*—John T. Kwon

*Attorney, Agent, or Firm*—Rockey, Milnamow & Katz, Ltd.

[57] ABSTRACT

The pump has an impeller with a retractable component, which, when moved, exposes more or less of the impeller blades, thereby varying the pumping action. The pump has rotor and stator sleeves with complementary tapered surfaces, in which a groove conveys barrier liquid towards the impeller. A piston and cylinder receives the liquid thus conveyed. The pressure of the liquid is controlled by a pressure regulator. A spring biasses the moveable impeller blades one way, and the piston and cylinder oppose that force, whereby the exposure of the impeller blades can be controlled.

15 Claims, 8 Drawing Sheets

PUMP IMPELLER WITH ADJUSTABLE BLADES

The invention is a development of the technology shown in PCT/CA-95/00362 (published 28 Dec. 1995, under WO-95135457.

BACKGROUND TO THE INVENTION

As shown in that patent, the outer tapered surface of a male rotor is in hydrodynamic-film-generating engagement with a complementary plain female stator sleeve. A spiral or helical groove cut in the surface of the male sleeve generates pressure when the sleeve is rotated.

PRIOR ART

U.S. Pat. No. 3,407,740 (Samerdyke, 1968) shows a means for varying the depth of the vanes or blades of the impeller of a rotary shaft-driven impeller pump. By varying the depth of the blades, the pump can be adjusted to operate at near peak efficiency over a range of operating conditions.

However, one problem with Samerdyke is that the pump has to be stopped in order to adjust the blades. The invention is aimed at providing a means for moving the adjustable vanes, which is operable from outside the pump, when the pump is running, whereby the pump does not have to be stopped for adjustment purposes. It is an aim also to provide such a means which does not impose the need for high-pressure rotary seals. High pressure rotary seals are notoriously expensive, or short-lived, or both.

GENERAL DESCRIPTION OF THE INVENTION

The invention lies in harnessing the pressure generated in the barrier liquid by the effect of the spiral groove, to provide the power needed for operating the means for moving the adjustable blade arrangement.

The preferred features of the invention are as follows.

The impeller includes a component that is movable axially relative to the shaft, and the axial movement thereof is effective to vary the depth of the blades, and thereby to vary the pumping action.

In accordance with '362, the apparatus includes a rotor sleeve, which is driven by the shaft, and which has a tapered outer surface, and includes a stator sleeve, which has a complementarily-tapered inner surface.

The rotor sleeve is provided with a helical or spiral groove, formed in the outer tapered surface, the groove having an entry mouth at one end and an exit mouth at the other end of the groove, and the apparatus includes an entry chamber, a means for supplying barrier liquid to the entry chamber, and the entry chamber connects with the entry mouth of the groove. Also, an exit chamber is in liquid-flow-communication with the exit mouth of the groove, for receiving barrier liquid from the exit mouth of the groove.

The tapered surfaces of the rotor and stator sleeves lie, during operation of the pump, in a hydrodynamic-film generating relationship.

The apparatus includes an actuator assembly, comprising a piston and complementary cylinder, which are mounted for rotation with the shaft. The exit chamber connects with the actuator assembly, whereby barrier liquid in the exit chamber can pass into, and pressurise, the cylinder.

The apparatus includes an operable pressure regulator, for regulating the pressure of the barrier liquid in the exit chamber and cylinder, and the piston and cylinder, in response to pressure of the barrier liquid in the cylinder, thereby comprise a means for adjusting the position of the movable impeller component axially relative to the shaft.

Preferably, the piston and cylinder comprise a means for exerting a force on the movable impeller component in one direction, and a spring is provided for exerting an axial biassing force on the moveable impeller component in the opposite direction.

Preferably, the spring and the piston and cylinder are so arranged in the apparatus that the spring biasses the moveable component in the direction to increase the pumping action of the impeller, whereby, the higher the pressure of the barrier liquid in the cylinder, the less the pumping action of the impeller.

The impeller may be so arranged that the moveable impeller component has the blades formed thereon, and the fixed impeller component comprises a slotted plate, having slots corresponding to the blades, and which overlie the blades, whereby, when the moveable component is moved axially, the slotted plate is moved to expose more or less of the depths of the blades.

Preferably, however, the fixed impeller component has the blades formed thereon, and the movable impeller component comprises a slotted plate, having slots corresponding to the blades, and which overlie the blades, whereby, when the moveable component is moved axially, the slotted plate is moved to expose more or less of the depths of the blades.

Preferably, the impeller components include a means for shrouding the outer diameter of the impeller, being a means for preventing process fluid outside the impeller from passing behind the slotted plate.

Preferably, the apparatus includes means for recirculating the barrier liquid from the exit chamber, through the pressure regulator, and back to the inlet chamber.

BRIEF DESCRIPTION OF THE DRAWINGS

By way of further explanation of the invention, exemplary embodiments of the communication invention will now be described with reference to the accompanying drawings, in which.

DETAILED DESCRIPTION OF THE PREFERRED EMBODIMENTS

The apparatuses shown in the accompanying drawings and described below are examples which embody the invention. It should be noted that the scope of the invention is defined by the accompanying claims, and not necessarily by specific features of exemplary embodiments.

Figure 1:
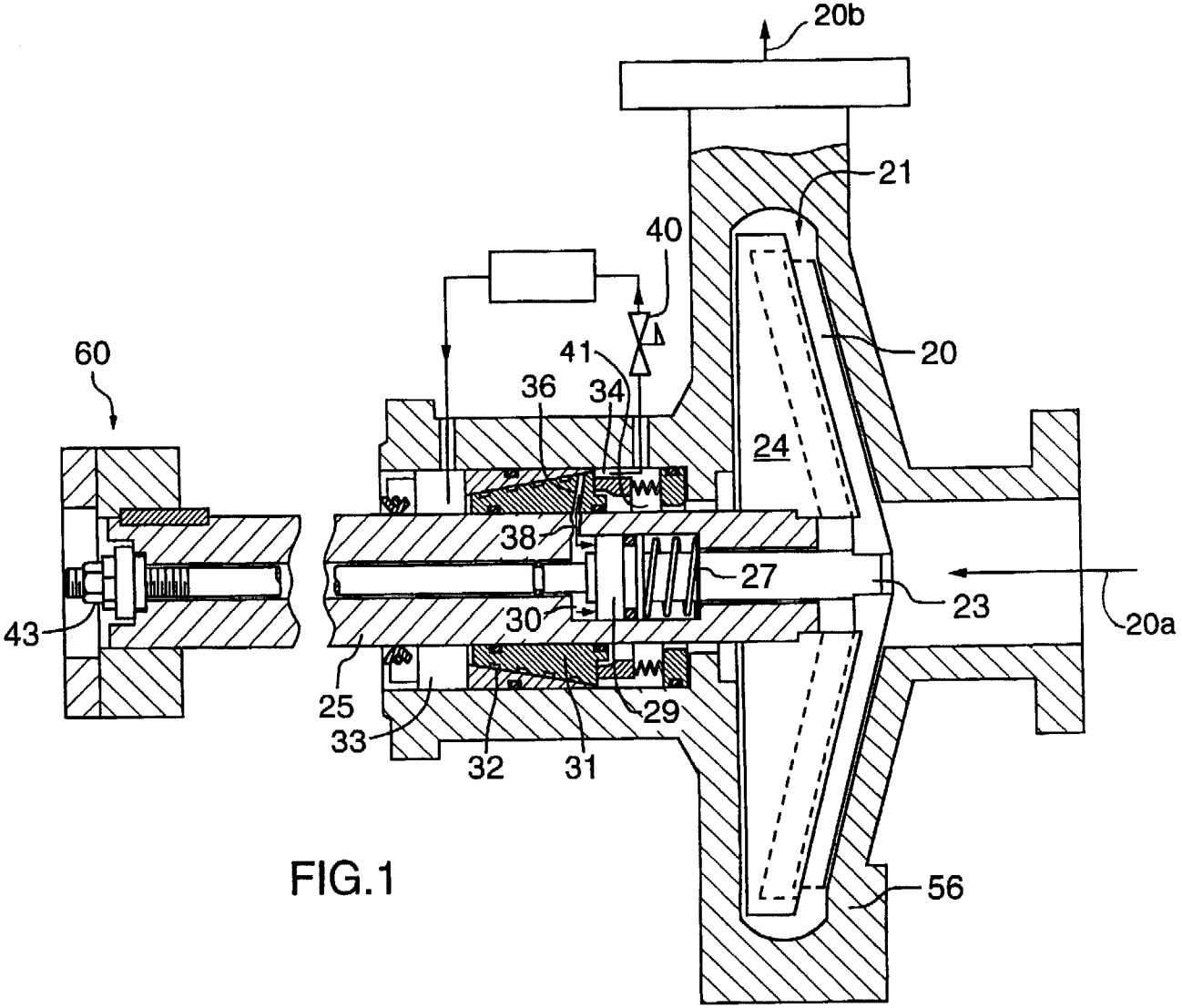
FIG. 1 is a cross-section of a pump.
Figure 2:
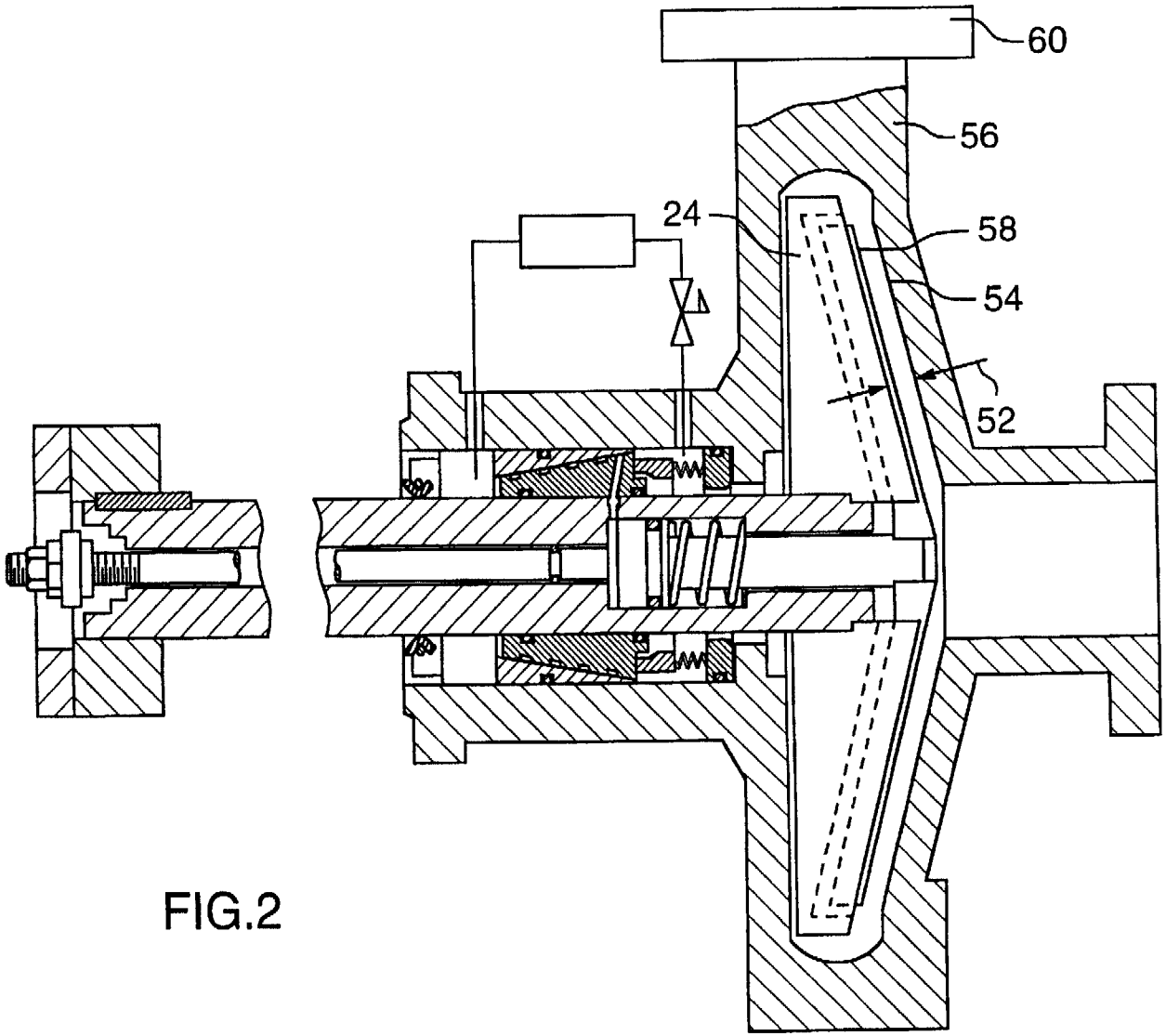
FIG. 2 is a corresponding cross section of the pump of FIG. 1, shown in a different operating condition.

FIGS. 1 and 2 illustrate a pump with a rotating impeller.

In FIG. 1, the retractable blades 20 of an impeller assembly 21 are fixed to a spindle 23, which rotates with the pump shaft 25, but is axially movable within the shaft. The impeller assembly 21 also includes a backing plate 24, which is fixed to the shaft 25.

Indicators 20*a*, 20*b* represent pump suction and pump discharge respectively.

A spring 27 pushes the spindle 23 to the left, i.e towards the position in which the blades protrude the least, and in which the pumping action is therefore at a minimum. The spindle 23 is fixed to a piston 29, and pressure in a cylinder 30 urges the piston to the right. The spindle 23, and with it the blades 20, can be moved to the right by applying pressure to the cylinder 30, whereby the impeller blades 20 are caused to protrude further from the backing plate 24, thereby increasing the pumping action.

Keyed to the shaft 25 is a sleeve 31, with a tapered surface 32, in which is cut a spiral groove. The groove is open to barrier liquid in inlet chamber 33 at the left end of the groove. When the shaft 25 is in rotation, the groove drives the liquid to the right, thus generating a pressure at the right end of the groove, in the exit chamber 34.

A passage 36 in the tapered sleeve 31 leads from the chamber 34 radially inwards, and couples with a passage 38 in the shaft 25, which leads into the cylinder 30.

Pressure regulator 40 can be adjusted from outside, and it will be understood that the pressure set by the regulator 40 dictates the pressure in the chamber 34, and hence in the cylinder 30, i.e the pressure which acts on the piston 29.

Quite high pressures can be generated by means of the grooved tapered sleeve, as was explained in '362. It follows, therefore, that substantial forces can be developed in the cylinder 30. It will be understood that this pressure is controlled by the pressure regulator, and that the pressure regulator can be adjusted from outside. The pressure regulator 40 can be set for example at 50 p.s.i. when the discharge pressure of the pump is at 40 p.s.i. The pressure downstream of the regulator 40 can have a zero pressure return.

Thus, the axial position of the blades 20 can be controlled, form outside the pump, by adjusting the pressure regulator 40. It will be understood that this pressure can be adjusted while the pump is being driven in rotation.

The pressure is communicated to the inside of the shaft, it will be noted, without the need for special high-pressure rotary seals to support the high pressure. The rotary-shaft seals shown in FIG. 1 are present in any event in the type of pump seal/bearing arrangement as described in '362. The area indicated at 41 is subjected to process pressure.

FIG. 2 shows the same components, but with the pressure regulator 40 set to (near) zero. Now, the pressure in the cylinder is not enough to compress the spring, and the spindle moves to the left, thus retracting the blades. The impeller is fully retracted.

The extremities of travel of the spindle are set by a locknut arrangement 43 located at a conveniently accessibly point outside the pump. In FIG. 1 the impeller blades are fully advanced to the right, the limit set by the lock nut arrangement 43.

When the blades 20 are fully retracted, as shown in FIG. 2, the blades are almost disappeared into the impeller back plate 24, leaving a considerable gap 52 between the inside surface 54 of the pump housing 56 and the rightmost extremities 58 of the blades 20. The possibility can arise that the pumped process fluid, upon emerging radially from the impeller, instead of passing directly to the outlet 60, can leak back through this gap, and then be re-pumped or re-circulated through the impeller. If this should happen, it can lead to unwanted heating of the process fluid, and a loss of efficiency. The larger the gap 52, the more likely it is that the process fluid can leak back: whether it does or not depends on other factors such as the viscosity of the process fluid, speed of rotation, etc.

Figure 3:
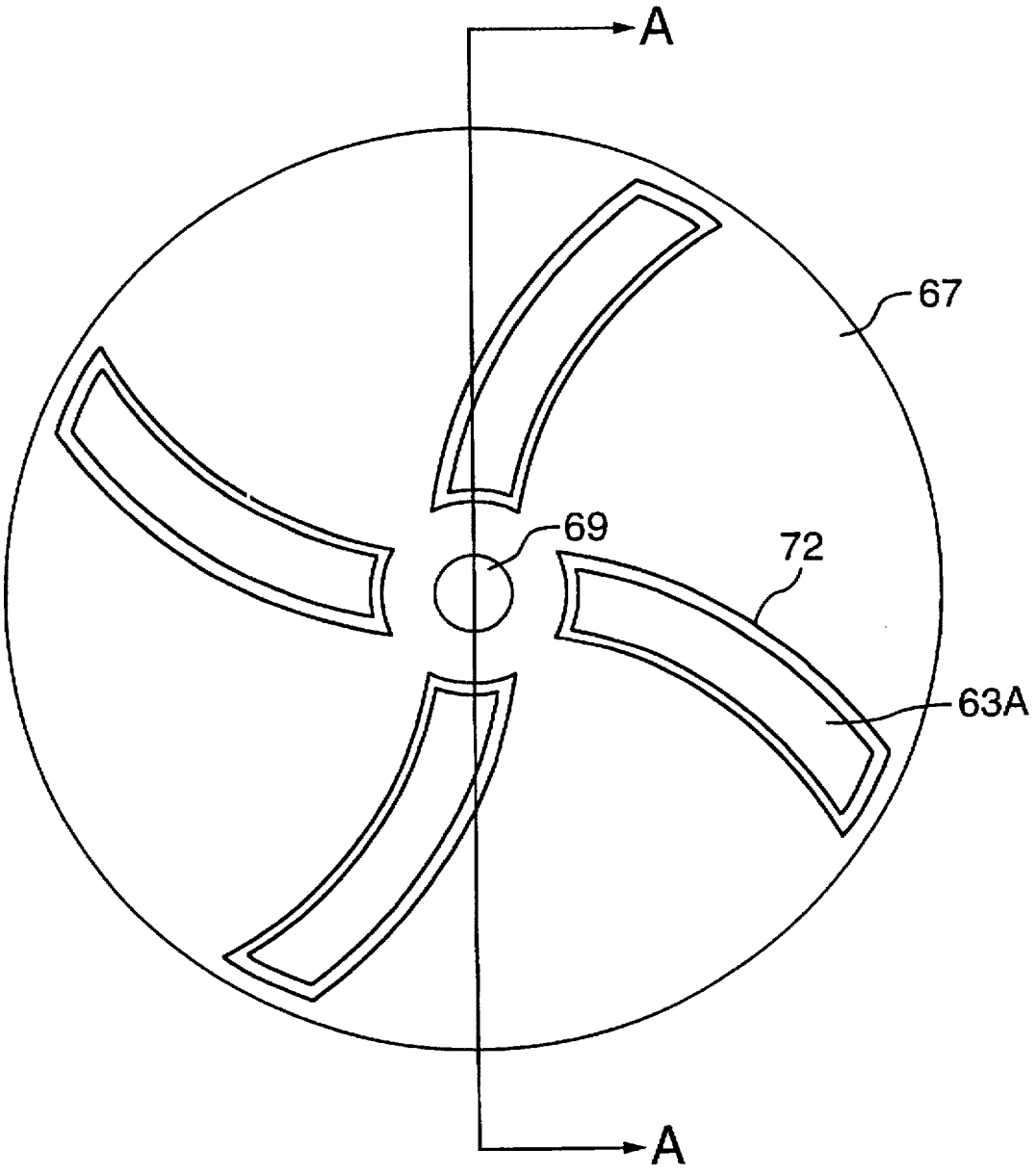
FIG. 3 is an end elevation of a pump blade and plate assembly.
Figure 4:
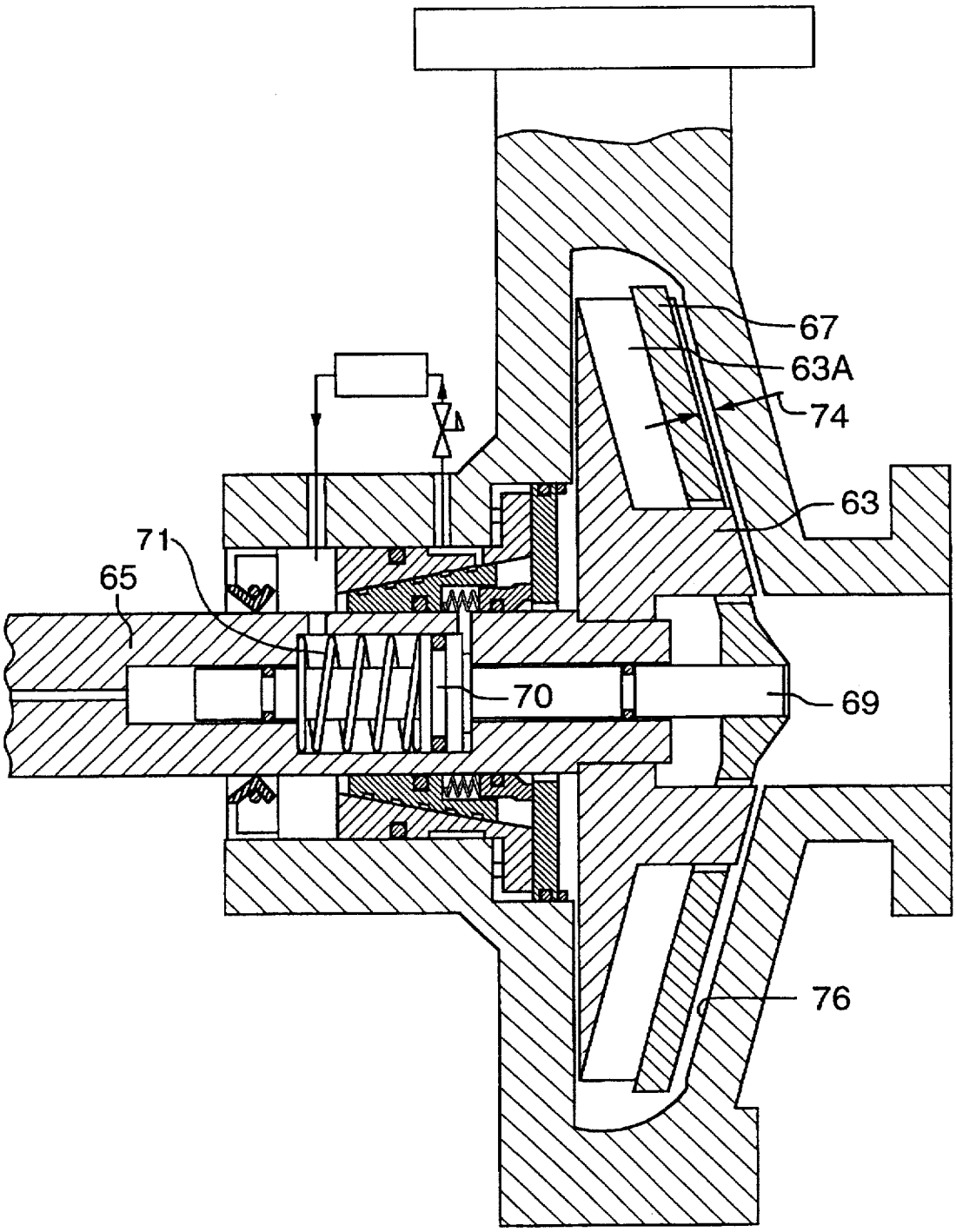
FIG. 4 is a cross-sectional view on line AA of FIG. 3, of a pump which includes the components shown in FIG. 3.
Figure 5:
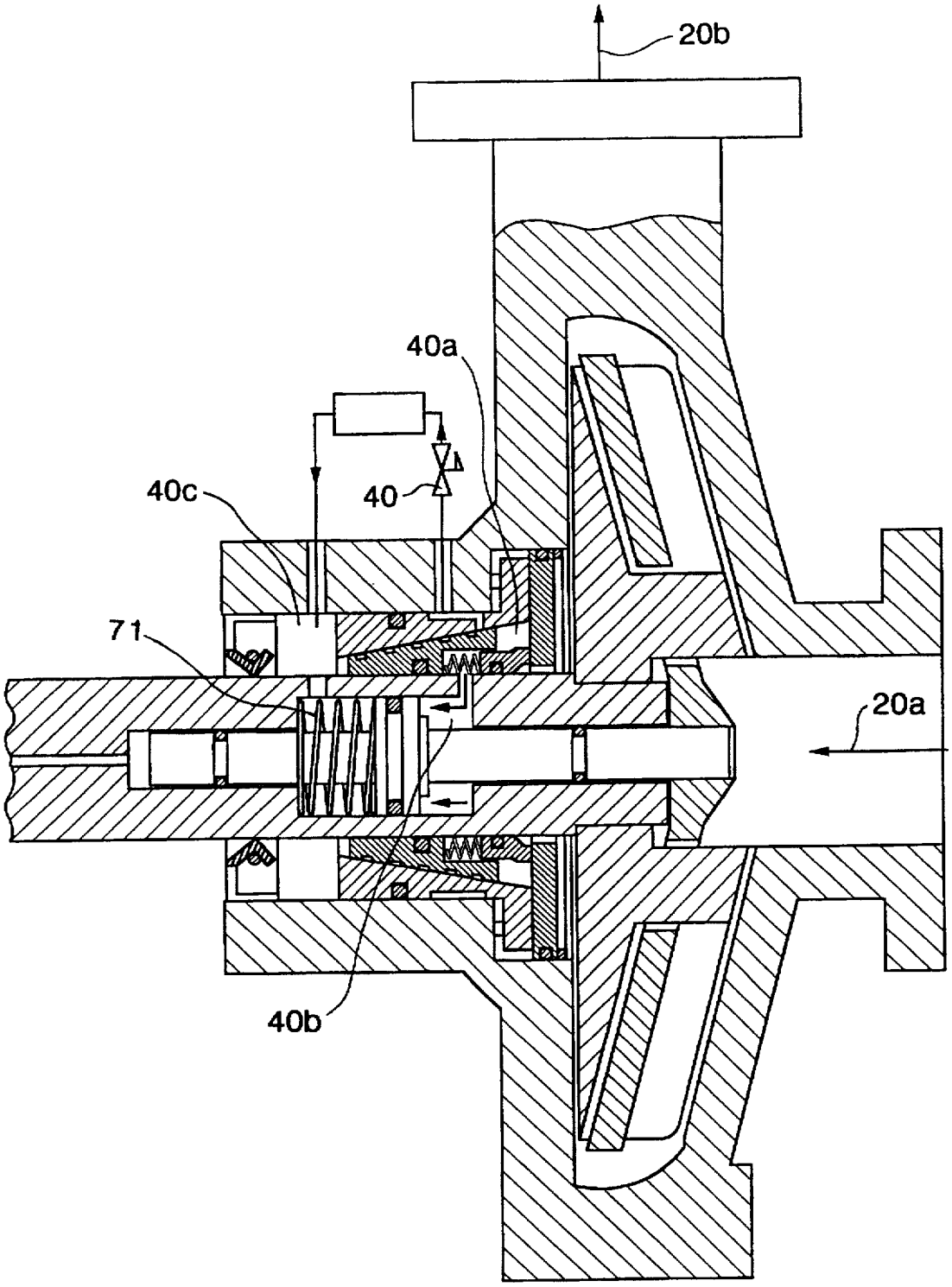
FIG. 5 is a view corresponding to FIG. 4, showing the pump in a different condition.

The pumps shown in FIGS. 3,4,5 avoid this problem. In these pumps, the impeller is provided, not with movable blades, but with a movable impeller plate. In FIG. 4, the blades structural unit 63, having blades 63A, is unitary with the pump drive shaft 65, and is not movable axially; the plate 67 is secured to the inner spindle 69, and can move axially under the control of the pressure acting on the piston 70. which is backed by a piston return spring 71.

The plate 67 is formed with windows or slots 72 (FIG. 3), through which the blades 63A protrude. When the plate is to the right (FIG. 4), the blades 63A protrude only a short distance out from the plate 67, and little pumping takes place.

It will be noted that when the blades protrude the least, and pumping is at a minimum, the gap 74 (corresponding to the gap 52 in FIG. 2) remains small, thus avoiding the problem referred to of the process fluid leaking back and being re pumped. In fact, the designer may set the gap 74 to be just large enough to ensure that the impeller components can never touch the inside surface 76 of the housing —as he would with a conventional pump.

In FIG. 4 the regulator is deactivated, i.e., zero pressure circulation.

FIG. 5 is the same view of the pump as FIG. 4, except that the plate moved to its leftmost position; the blades 63A are now exposed through the windows 72 to their furthest extent, whereby pumping of the process fluid is at a maximum.

FIG. 5 shows the regulator activated with high regulated pressure at location 40*a* acting on the piston at 40*b*. The regulator has zero pressure return at 40*c*. The return spring 71 is compressed. The indicators 20*a* and 20*b* indicate the pump suction and pump discharge respectively.

As shown in FIG. 1, the pump shaft 20 is driven by e.g an electric motor (not shown), which drives the shaft through a torque coupling 60. These components are located to the left in FIG. 1. The shaft 20 is mounted in bearings (not shown—but they guide the shaft 25 between the coupling 60 and the left end of the housing 56) whereby the portion of the shaft in the pump, as shown in FIG. 1, overhangs the shaft bearings. This shaft /bearing layout is conventional.

Figure 6:
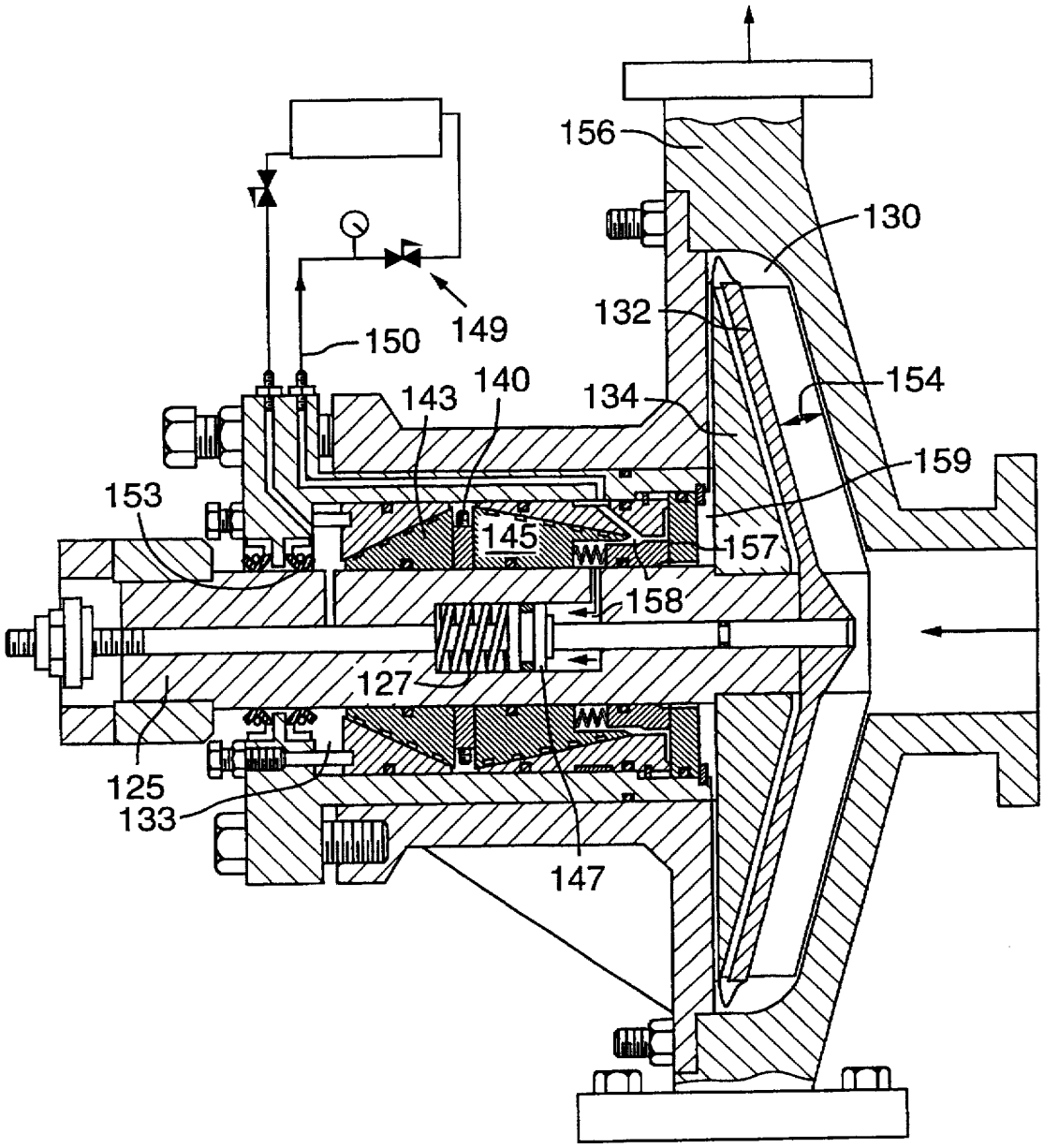
FIG. 6 is a cross-section of another pump, having an adjustable impeller.

In FIG. 6, on the other hand, the shaft 125 is not supported in outside bearings. Rather, the shaft is supported in back-to-back tapered sleeves 143,145. These rotor, male, sleeves both have the spiral groove, which serve to pump barrier liquid towards the impeller. The sleeves fit the corresponding female stator sleeves, which are secured into the housing 156. The back-to-back sleeves assembly comprises a bearing for guiding the shaft 125. The bearing is both a journal and a thrust bearing.

The impeller 130 of the pump of FIG. 6 is exposed to process fluid being pumped, as shown at the right end of FIG. 6. The impeller 130 is made in two components, which are relatively movable axially. Axial movement of the vane-receiving plate 132 of the impeller relative to the vane-carrying backing plate 124 is effective to adjust the size (i.e the depth) of the vanes. The designer arranges that the depth of the vanes is adjustable so as to obtain maximum efficiency (or some other desired criterion) under a wide variety of conditions of pump speed, pressure, viscosity, density, etc. This may be contrasted with a conventional (i.e non-adjustable) impeller, in which the designer must compromise performance and efficiency when catering for changing parameters.

Axial movement of the vane component 132 is controlled by a hydraulic piston 147. The spiral grooves provide the pressurised barrier liquid for operating the piston 147. The pressure of the barrier liquid is controlled from outside, whereby, by adjusting the barrier pressure, the depth of the vanes may be controlled. The barrier liquid pressure (and hence the vane depth) may be controlled from a remote location, e.g a pressure regulator 149, if desired. The pressure, flow rates, etc, of the process fluid may be monitored, the feedback therefrom being used to assist in the control of the vane depth.

It may be noted that the pressure of the barrier liquid supplied to the inlet chamber 133 is at, or near, atmospheric pressure. Therefore, the seal 153 at the left end of the inlet chamber is not subject to a demanding pressure differential.

The mechanical seal 157 between the exit chamber 158 and the process chamber 159, however, can encounter rather larger pressure differentials. It may be noted, though, that the pressure in the chamber 158 is highest when the spring 127 is at its most compressed, i.e when the vane component 132 is towards the left. The further the component 132 is towards the left, the greater the pumping action. Therefore, when the pressure in the exit chamber (and cylinder) 158 is at its highest, that is the very time when the pumping action is greatest, and therefore, the process pressure is likely to be at an elevated value.

While it is not always necessarily true that the greatest pumping action produces the highest process pressure, at least the effect is that the mechanical seal 157 is not often exposed to over-demanding pressure differentials. Besides, if a condition arises which turns out to be too much for the pump or the seals, the pressure regulator 149 can be operated, and the situation relieved. The designer must see to it, of course, that the pump is properly selected to deal with the range of duties likely to be encountered.

Figure 7:
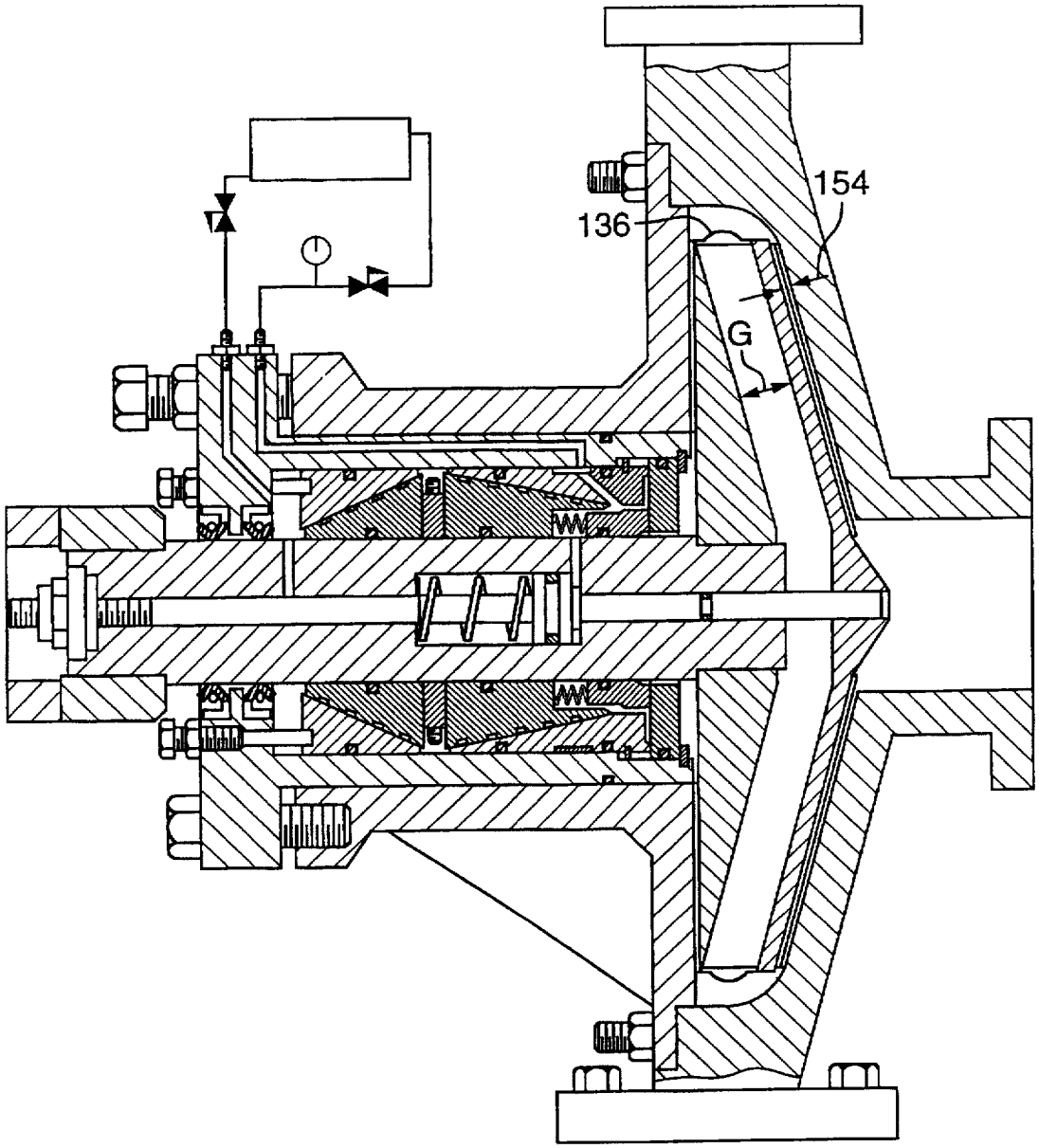
FIG. 7 is a corresponding cross-section to FIG. 6, with the impeller in a different condition.

The arrangement of the impeller in FIG. 6 is such that, as shown in FIG. 7, when the vane depth 152 is adjusted to be shallow, a space or gap G is created behind the vane component 132. In some cases, process fluid might tend to enter this gap, and, if so, to be pumped thereby. If this happened, the efficiency of the pump might be compromised.

Therefore, a means for preventing the process liquid from entering the gap G is provided. This takes the form of a diaphragm 136 of elastomeric material. The diaphragm is flexible enough to exclude the process fluid throughout the extent of the axial travel of the vane component.

Figure 8:
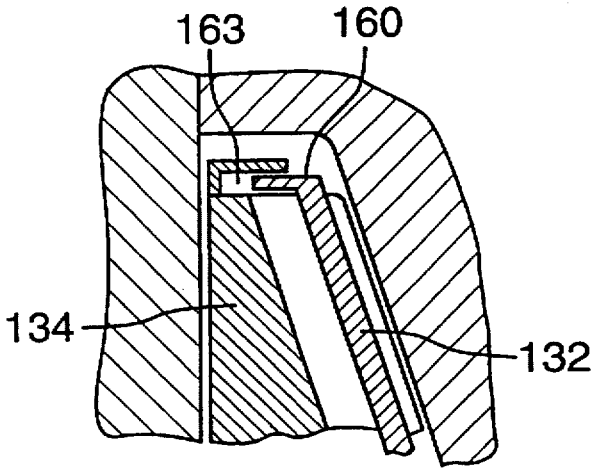
FIG. 8 is a corresponding cross-section of a portion of another pump.

FIG. 8 shows another structure for preventing pumped process fluid from entering the spaces behind the vane component 132. Here, the vane component includes a ring 160, which can slide into an annular space 163 defined in the blade-carrying backing plate 134.

As shown in FIG. 6, the barrier liquid control circuit 149 supplies barrier liquid to the sleeves at zero pressure. The pressure in the piston is controlled by regulating the pressure in the return line 150. The barrier liquid may be water, or oil, as dictated by the various pumping parameters.

I claim:

1. Rotary pump apparatus, having;

a rotary impeller and a driven shaft, wherein the impeller is mounted for rotation with the shaft, and includes a movable impeller component which is movable axially relative to the shaft;

the impeller includes blades for pumping process fluid;

the blades are adjustable, to vary the pumping action, responsively to axial movement of the movable component along the shaft;

a rotor sleeve, which is driven by the shaft, and which has a tapered outer surface;

a stator sleeve, which has a complementarily-tapered inner surface;

the rotor sleeve has a helical groove, formed in the outer tapered surface, the groove having an entry mouth at one end and an exit mouth at the other end of the groove;

the tapered surfaces of the rotor and stator sleeves lie, during operation of the pump, in a hydrodynamic-film generating relationship;

an entry chamber, and a means for supplying barrier liquid to the entry chamber;

the entry chamber is in liquid-flow-communication with the entry mouth of the groove;

an exit chamber, which is in liquid-flow-communication with the exit mouth of the groove, for receiving barrier liquid from the exit mouth of the groove;

an actuator assembly, comprising a piston and complementary cylinder, which are mounted for rotation with the shaft;

the exit chamber is in liquid-flow-communication with the actuator assembly, whereby barrier liquid in the exit chamber can pass into, and pressurize, the cylinder;

an operable pressure regulator, for regulating the pressure of the barrier liquid in the exit chamber and cylinder;

the piston and cylinder, in response to pressure of the barrier liquid in the cylinder, comprise a means for adjusting the position of the movable impeller component axially relative to the shaft.

2. Apparatus of claim 1, wherein the impeller includes a fixed impeller component, and a means for constraining the fixed impeller component against axial movement thereof relative to the shaft.

3. Apparatus of claim 2, wherein the fixed impeller component and the movable impeller component cooperate to define the blades of the impeller.

4. Apparatus of claim 3, wherein:

the piston and cylinder comprise a means for exerting a force on the movable impeller component in a first axial direction;

the actuator assembly includes a spring, for exerting an axial biasing force on the moveable impeller component;

the direction of the biasing force of the spring is in the opposite axial direction to the force from the piston and cylinder.

5. Apparatus of claim 4, wherein:

the spring and the piston and cylinder are so arranged in the apparatus that the spring biasses the moveable impeller component in the direction to increase the pumping action of the impeller;

whereby, the higher the pressure of the barrier liquid in the cylinder, the less the pumping action of the impeller.

6. Apparatus of claim 3, wherein:

the moveable impeller component has blades formed thereon;

the fixed impeller component comprises a slotted plate, having slots corresponding to the blades, and which overlie the blades;

whereby, when the moveable component is moved axially, the slotted plate is moved to adjust the depths of the blades.

7. Apparatus of claim 3, wherein:

the fixed impeller component has blades formed thereon;

the movable impeller component comprises a slotted plate, having slots corresponding to the blades, and which overlie the blades;

whereby, when the moveable component is moved axially, the slotted plate is moved to adjust of the depths of the blades.

8. Apparatus of claim 7, wherein the fixed and moveable impeller components include a means for shrouding the outer diameter of the impeller, being a means for preventing process fluid outside the impeller from passing behind the slotted plate.

9. Apparatus of claim 1, wherein the apparatus includes means for recirculating the barrier liquid from the exit chamber, through the pressure regulator, and back to the inlet chamber.

10. Apparatus of claim 5, wherein:

the fixed impeller component has blades formed thereon;

the movable impeller component comprises a slotted plate, having slots corresponding to the blades, and which overlie the blades;

whereby, when the moveable component is moved axially, the slotted plate is moved to adjust of the depths of the blades.

11. A rotary apparatus, comprising:

an impeller;

a housing located within said housing;

a driven shaft located at least partially within said housing, said impeller mounted for rotation with said shaft;

a rotor sleeve, driven by said shaft, and which has a tapered outer surface;

a stator sleeve, having a complementarily-tapered inner surface to said tapered outer surface, said stator sleeve fixed with respect to said housing;

one of said rotor or stator sleeves having a helical groove formed on its respective tapered surface;

said tapered surfaces of said rotor and said stator sleeves lie, during operation of said shaft, in a hydrodynamic-film generating relationship;

an entry chamber being in liquid-flow-communication with said entry mouth of said groove;

an exit chamber being in liquid-flow-communication with said exit mouth of said groove, for receiving liquid from said exit mouth of said groove; and an actuator in liquid-flow-communication with said liquid in said exit chamber, said actuator responding to pressure of said liquid in said exit chamber to control operation of said impeller.

12. The rotary apparatus of claim 11, wherein said actuator includes a piston and complementary cylinder, and said liquid in said exit chamber can pass into, and pressurize, said cylinder.

13. The rotary apparatus of claim 12, further including an operable pressure regulator in liquid communication with said cylinder for regulating said pressure of said liquid in said cylinder.

14. The rotary apparatus of claim 13, further including a flow conduit arranged between said exit chamber and said entry chamber to recirculate fluid from said exit chamber through said pressure regulator and back to said entry chamber.

15. The rotary apparatus of claim 11, wherein said actuator is operatively connected to said impeller to adjust position of said impeller within said housing.

* * * * *

UNITED STATES PATENT AND TRADEMARK OFFICE

CERTIFICATE OF CORRECTION

PATENT NO. : 5,800,120

DATED : September 1, 1998

INVENTOR(S) : Thomas W. Ramsay

It is certified that error appears in the above-identified patent and that said Letters Patent is hereby corrected as shown below:

At col. 6, line 60, change "increase" to –decrease–.
At col. 6, line 63, change "less" to –more–.

Signed and Sealed this

Eighteenth Day of May, 1999

*Attest:*

*Attesting Officer*

Q. TODD DICKINSON

*Acting Commissioner of Patents and Trademarks*